US009816515B2

(12) United States Patent
Iwamoto et al.

(10) Patent No.: US 9,816,515 B2
(45) Date of Patent: Nov. 14, 2017

(54) CEILING FAN

(71) Applicant: Panasonic Intellectual Property Management Co., Ltd., Osaka (JP)

(72) Inventors: Kiyohiko Iwamoto, Aichi (JP); Masayuki Sasaki, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 287 days.

(21) Appl. No.: 14/443,394

(22) PCT Filed: Nov. 18, 2013

(86) PCT No.: PCT/JP2013/006750

§ 371 (c)(1),
(2) Date: May 18, 2015

(87) PCT Pub. No.: WO2014/080607

PCT Pub. Date: May 30, 2014

(65) Prior Publication Data

US 2015/0330619 A1 Nov. 19, 2015

(30) Foreign Application Priority Data

Nov. 22, 2012 (JP) ..... 2012-256193
Dec. 18, 2012 (JP) ..... 2012-275391

(51) Int. Cl.
*F04D 25/08* (2006.01)
*F21V 29/77* (2015.01)
(Continued)

(52) U.S. Cl.
CPC ..... *F04D 25/088* (2013.01); *F04D 19/002* (2013.01); *F04D 25/06* (2013.01);
(Continued)

(58) Field of Classification Search
CPC ... F04D 29/005; F04D 29/088; F21V 33/0096
See application file for complete search history.

(56) References Cited

U.S. PATENT DOCUMENTS 7,784,973 B2 * 8/2010 Zhang ..... F21S 8/033 362/294
8,408,759 B1 * 4/2013 Rashidi ..... F21S 8/026 362/150

(Continued)

FOREIGN PATENT DOCUMENTS

CN 1880841 12/2006
CN 201078676 Y 6/2008

(Continued)

OTHER PUBLICATIONS

International Search Report of PCT application No. PCT/JP2013/006750 dated Feb. 10, 2014.

(Continued)

*Primary Examiner* — Gregory Anderson
*Assistant Examiner* — Juan G Flores
(74) *Attorney, Agent, or Firm* — Panasonic IP Management; Kerry S. Culpepper

(57) ABSTRACT

A ceiling fan includes a support, a motor portion, a blade portion, control section, illumination portion, and case. Illumination portion includes lower illumination cover, upper illumination cover, and LED substrate portion. Heat dissipation plates are provided on a side of upper illumination cover.

8 Claims, 6 Drawing Sheets

(51) Int. Cl.

| | |
|---|---|
| ***F04D 19/00*** | (2006.01) |
| ***F04D 29/32*** | (2006.01) |
| ***F04D 25/06*** | (2006.01) |
| ***F04D 29/58*** | (2006.01) |
| ***F21V 9/16*** | (2006.01) |
| ***F21V 33/00*** | (2006.01) |
| ***F04D 29/00*** | (2006.01) |
| *F21W 131/30* | (2006.01) |
| *F21Y 115/10* | (2016.01) |

(52) U.S. Cl.
CPC ..... *F04D 29/005* (2013.01); *F04D 29/329* (2013.01); *F04D 29/5853* (2013.01); *F21V 9/16* (2013.01); *F21V 29/773* (2015.01); *F21V 33/0096* (2013.01); *F21W 2131/30* (2013.01); *F21Y 2115/10* (2016.08)

(56) References Cited

U.S. PATENT DOCUMENTS

| | | | | |
|---|---|---|---|---|
| 8,672,649 | B2 * | 3/2014 | Smith | F04D 25/088 417/42 |
| 8,727,565 | B2 * | 5/2014 | Domagala | F21K 9/233 362/235 |
| 8,803,414 | B2 * | 8/2014 | Van De Ven | F21S 8/02 313/498 |
| 9,151,457 | B2 * | 10/2015 | Pickard | F21S 8/026 |
| 2006/0274538 | A1 | 12/2006 | Bacon et al. | |
| 2010/0208473 | A1 | 8/2010 | Sakai et al. | |

FOREIGN PATENT DOCUMENTS

| | | |
|---|---|---|
| JP | 2006-219998 | 8/2006 |
| JP | 2007-107393 | 4/2007 |
| JP | 2007-107419 | 4/2007 |
| JP | 2008-297939 | 12/2008 |
| JP | 2010-101214 | 5/2010 |
| JP | 2010-108804 | 5/2010 |
| JP | 2010-192337 A | 9/2010 |
| MY | 142731 | 12/2010 |

OTHER PUBLICATIONS

English Translation of Chinese Search Report dated Aug. 24, 2016 for the related Chinese Patent Application No. 01380061120.6.

* cited by examiner

CEILING FAN

TECHNICAL FIELD

The present invention relates to a ceiling fan.

BACKGROUND ART

A conventional ceiling fan equipped with illumination is constituted by a support, a motor portion, blade portions, a control section, an illumination portion, and a case. The support joins the ceiling fan to a ceiling. The motor portion is provided at a lower portion of the support. The blade portions are rotated by the motor portion. The control section is provided below the motor portion. The illumination portion is provided below the control section. The case covers at least a part of the motor portion, the control section, and the illumination portion (for example, see Patent Literature 1).

CITATION LIST

Patent Literature

PTL 1: Unexamined Japanese Patent Publication No. 2010-108804

SUMMARY OF THE INVENTION

According to the foregoing conventional ceiling fan, a heat generation quantity from the illumination portion becomes larger as illuminance of the illumination portion increases, and thus a temperature of the illumination portion rises. In addition, since the illumination portion is located below the control section, heat generated from the illumination portion is conducted to the control section, in which condition such a problem may arise that a temperature of the control section excessively rises.

A ceiling fan according to the present invention includes: a support; a motor portion provided at a lower portion of the support; a blade portion rotated by the motor portion; a control section provided below the motor portion; an illumination portion provided below the control section; and a case that covers at least a part of the motor portion, the control section, and the illumination portion. The illumination portion includes: a cylindrical lower illumination cover sandwiched between the control section and the case, and having a closed lower portion; a cylindrical upper illumination cover sandwiched between the lower illumination cover and the control section, and having a closed upper portion; and an LED substrate portion fixed to the upper illumination cover, a plurality of luminescence elements attached to the LED substrate portion. A heat dissipation portion is provided on a side of the upper illumination cover.

According to the ceiling fan thus constructed, since the heat dissipation portion is provided on the side of the upper illumination cover, heat generated from the luminescence elements is dissipated from the heat dissipation portion. Accordingly, a heat conduction quantity to the control section located above the illumination portion decreases, and therefore an excessive temperature rise in the control section is avoidable.

DESCRIPTION OF EMBODIMENT

An exemplary embodiment according to the present invention is hereinafter described with reference to the drawings.

Exemplary Embodiment

Figure 1:
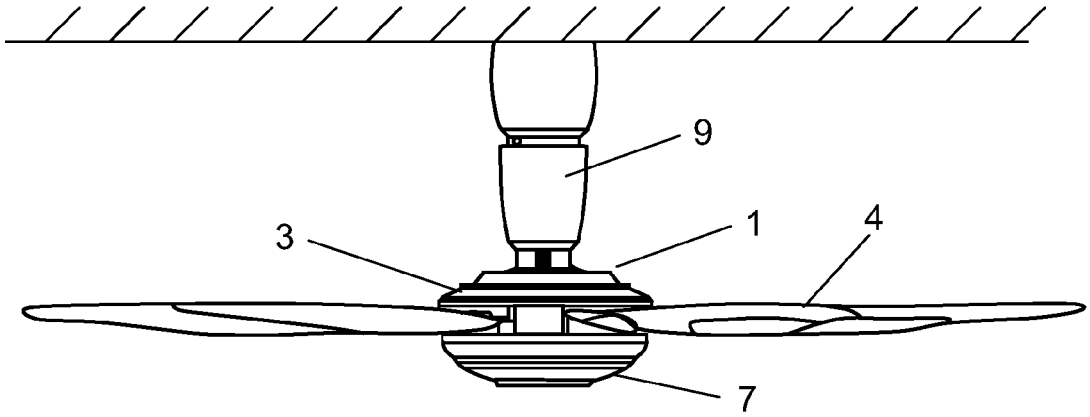
FIG. 1 is a front view illustrating an external appearance of a ceiling fan according to an exemplary embodiment of the present invention.
Figure 2:
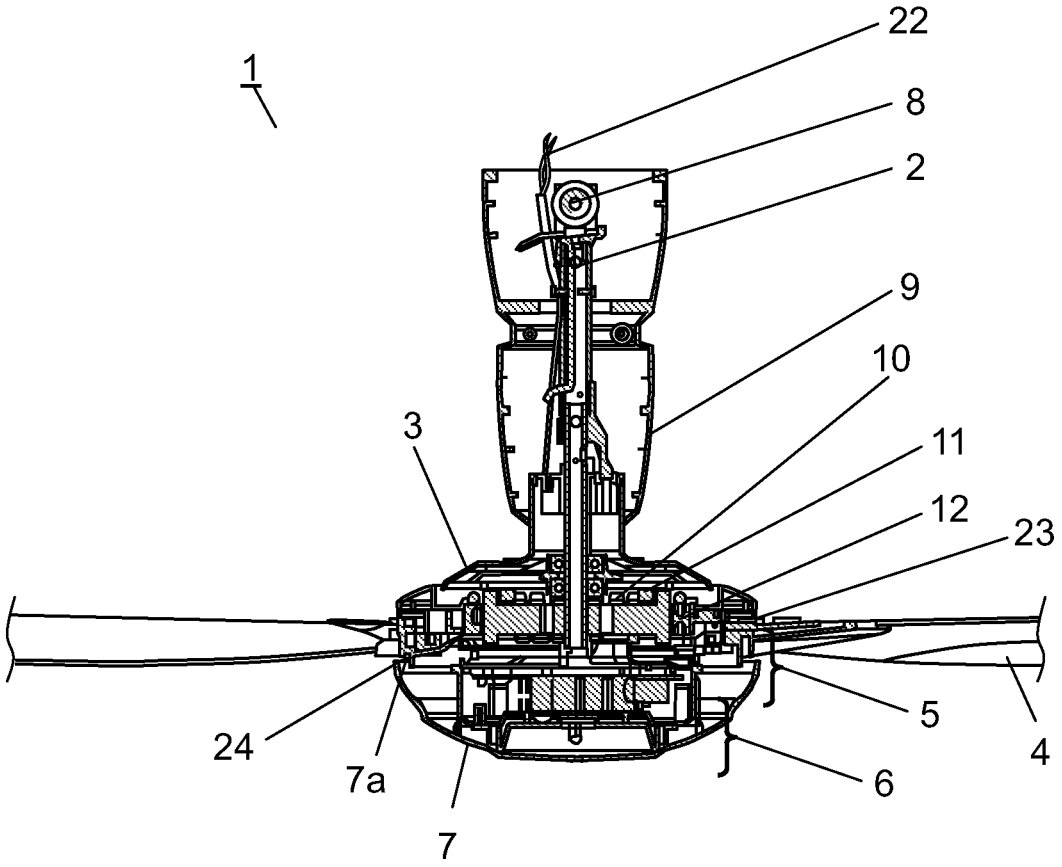
FIG. 2 is a cross-sectional view of the same ceiling fan.

FIG. 1 is a front view illustrating an external appearance of a ceiling fan according to the exemplary embodiment of the present invention. FIG. 2 is a cross-sectional view of the same ceiling fan. As illustrated in FIGS. 1 and 2, ceiling fan 1 is constituted by support 2, motor portion 3, blade portions 4, control section 5, illumination portion 6, case 7, and pipe cover 9.

Support 2 is hollow and bar-shaped. Hanging portion 8 capable of engaging with a ceiling is provided on an upper portion of support 2, while motor portion 3 is fixed to a lower portion of support 2. Cylindrical pipe cover 9 is provided around support 2.

Motor portion 3 is an outer rotor motor. Motor portion 3 is constituted by stator core 10, stator winding 11, and rotor 12.

Blade portions 4 are substantially rectangular plate-shaped, and rotated by motor portion 3. Blade portions 4 are provided in such a condition that one of short sides of each substantially square plate shape of blade portions 4 is detachably attached to support portion 23. Support portion 23 is fixed to a peripheral edge of motor portion 3, i.e., rotor 12, and provided on motor portion 3 in such a condition as to be rotatable together with rotor 12.

Case 7 is disposed below blade portions 4 and support portion 23. Case 7 is bowl-shaped and opened on an upper side, and covers at least a part of motor portion 3, control section 5, and illumination portion 6. Gap 24 is formed between case upper end portion 7*a* of case 7 and blade portions 4. A part of illumination portion 6 is exposed through gap 24 to emit light through gap 24.

Figure 3:
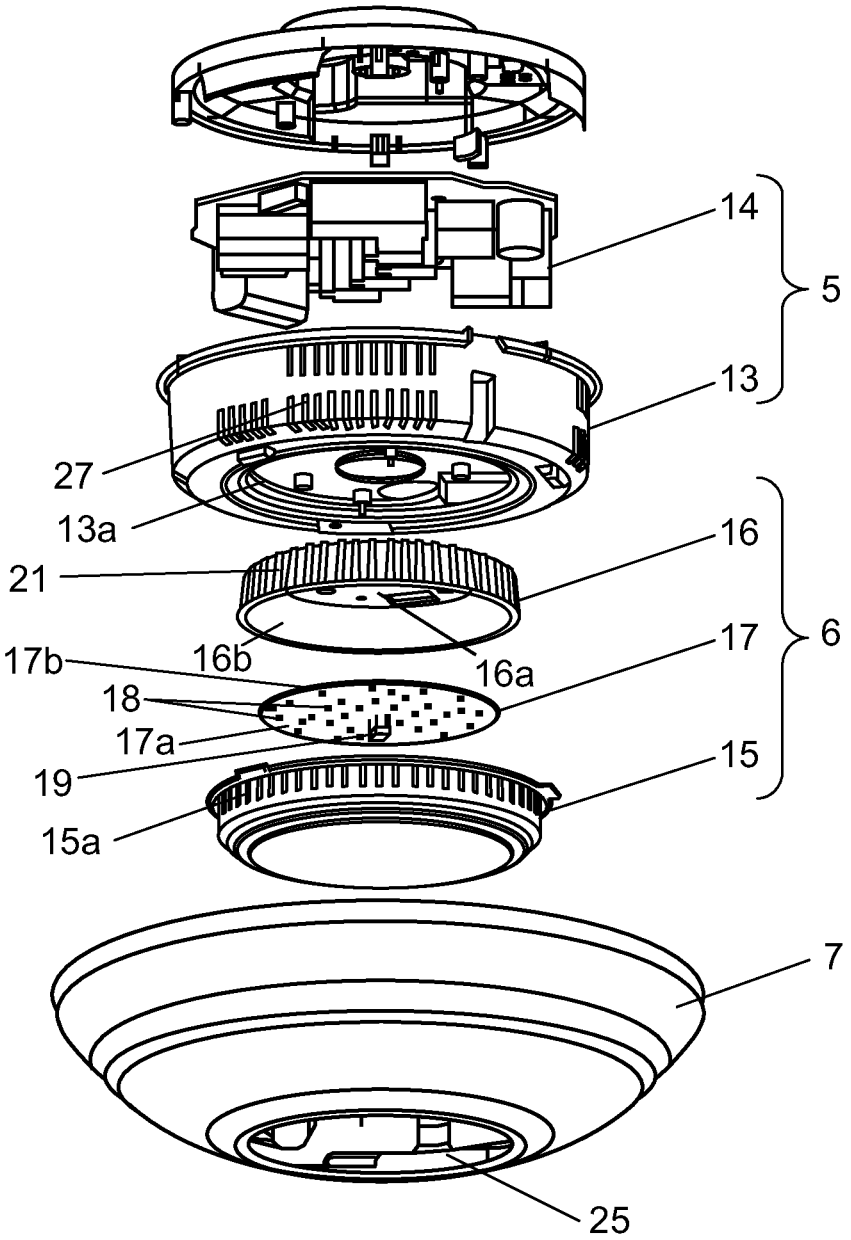
FIG. 3 is a developed view of an interior of a case of the same ceiling fan.

FIG. 3 is a developed view of an interior of the case of the ceiling fan according to the exemplary embodiment of the present invention. Control section 5 illustrated in FIG. 3 is provided below motor portion 3 illustrated in FIG. 2. Control section 5 is constituted by control case 13, and control board unit 14 provided within control case 13. Control case 13 is substantially bowl-shaped and opened on an upper side. A plurality of openings 27 are formed in a side of control case 13, and protruding portion 13*a* as downward protrusion is provided on a lower surface of control case 13. Control board unit 14 is electrically connected with motor portion 3, illumination portion 6, and power source electric wire 22 extending from a space above the ceiling, each components 3, 6, and 22 being illustrated in FIG. 2. Motor portion 3 and illumination portion 6 are controlled by control board unit 14.

As illustrated in FIG. 3, illumination portion 6 is provided below control section 5, and emits light downward from a lower surface of control case 13. Illumination portion 6 is constituted by lower illumination cover 15, upper illumination cover 16, and LED substrate portion 17.

Case opening 25 is formed in a lower portion of case 7, so that a part of illumination portion 6 is exposed through case opening 25. Lower illumination cover 15 is cylindrical and has a closed lower portion. Lower illumination cover 15 is sandwiched between control section 5 and case 7. Lower illumination cover 15 is made of resin material which has optical transparency, such as polycarbonate containing a dispersing agent. Lower illumination cover 15 houses upper illumination cover 16.

Upper illumination cover 16 is cylindrical and has a closed upper portion. Upper illumination cover 16 is sandwiched between lower illumination cover 15 and control section 5. An upper surface of upper illumination cover 16 contacts protruding portion 13*a*. This configuration produces a space between upper illumination cover 16 and control section 5. Upper illumination cover 16 is made of metal, such as aluminum. Upper inner surface of upper illumination cover 16*a* and upper illumination cover inner surface 16*b*, both constituting upper illumination cover 16, are formed integrally with each other. LED substrate portion 17 is disposed within upper illumination cover 16*b*.

As illustrated in FIG. 3, LED substrate portion 17 is fixed to upper illumination cover 16. A plurality of luminescence elements 18 and a receiving portion 19 are attached to LED substrate portion 17. Receiving portion 19 is disposed at a center of LED substrate portion 17 with a predetermined distance left from LED substrate portion 17 to receiving portion 19 in the downward direction. Receiving portion 19 receives, via lower illumination cover 15, signals transmitted from a remote controller. The signals are infrared signals, for example. Luminescence elements 18 are rectangular plate-shaped LED chips, for example. The plurality of LED chips are radially disposed around receiving portion 19.

Operation of ceiling fan 1 is now described. When a signal is transmitted from the remote controller, receiving portion 19 illustrated in FIG. 3 receives this signal. Then, motor portion 3 illustrated in FIG. 2 is driven, whereby blade portions 4 are rotated in accordance with the driving of motor portion 3. When an illumination button of the remote controller is pressed, receiving portion 19 receives an illumination signal to turn on illumination, change illuminance levels, or turn off illumination. The illuminance levels of illumination are three levels of high, middle, and low.

Figure 4:
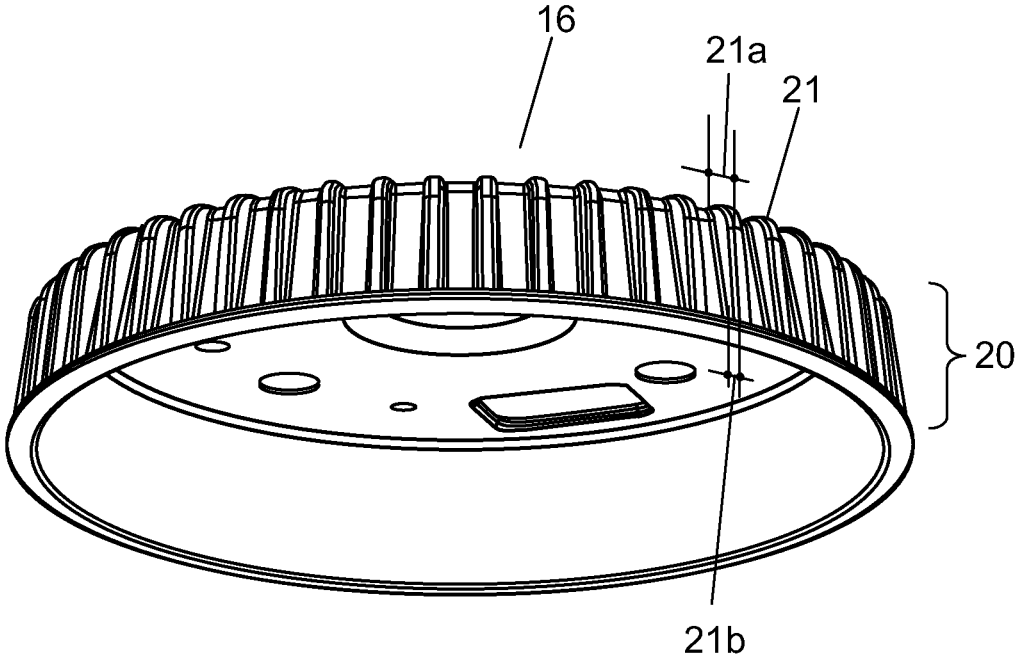
FIG. 4 is a perspective view of heat dissipation plates of the same ceiling fan.

FIG. 4 is a perspective view illustrating heat dissipation plates of the ceiling fan according to the exemplary embodiment of the present invention. As illustrated in FIGS. 3 and 4, the exemplary embodiment of the present invention is characteristic in configuration of upper illumination cover 16. More specifically, heat dissipation portion 20 is provided on a side of upper illumination cover 16. According to this configuration, heat generated from luminescence elements 18 is dissipated through heat dissipation portion 20, wherefore a heat conduction quantity given from an upper portion of illumination portion 6 to control section 5 decreases.

More specifically, heat dissipation portion 20 is constituted by heat dissipation plates 21, i.e., a plurality of plates extending from the side of upper illumination cover 16 toward the outside. Heat dissipation plates 21 extend radially from a center axis of lower illumination cover 15, and stretch downward. This configuration enlarges a surface area of the side of upper illumination cover 16, thereby increasing dissipation of heat from heat dissipation plates 21.

Upper illumination cover 16 becomes wider in the downward direction. Upper portion length 21*a* of protrusion of each of heat dissipation plates 21 from upper illumination cover 16 is longer than lower portion length 21*b* of protrusion of each of heat dissipation plates 21 from upper illumination cover 16. In other words, each of heat dissipation plates 21 is a trapezoidal plate having an upper side longer than a lower side. According to heat dissipation plates 21, therefore, a surface area in an upper portion of each of heat dissipation plates 21 is larger than a surface area in a lower portion of each of heat dissipation plates 21. This configuration increases dissipation of heat from the upper portion of each of heat dissipation plates 21, and increases the heat conduction quantity from an upper surface of upper illumination cover 16 toward heat dissipation plates 21.

Upper illumination cover 16 is made of aluminum. Aluminum has a large thermal conductivity, wherefore the heat conduction quantity becomes large from the upper surface of upper illumination cover 16 to heat dissipation plates 21. This condition reduces conduction of heat generated from luminescence elements 18 to control section 5 illustrated in FIG. 3.

LED substrate portion 17 illustrated in FIG. 3 is plate-shaped. The plurality of luminescence elements 18 are attached to lower surface 17*a* of the LED substrate portion. At least a part of upper surface 17*b* of the LED substrate portion is in contacts with upper inner surface of upper illumination cover 16*a*. Thereby, heat generated from luminescence elements 18 is conducted to upper illumination cover 16 via LED substrate portion 17, wherefore a temperature rise within upper illumination cover 16 decreases.

Upper illumination cover inner surface 16*b* of upper illumination cover 16 illustrated in FIG. 3 is white-colored. More specifically, upper illumination cover inner surface 16*b* is painted in white-colored. When light emitted from luminescence elements 18 is applied to white-colored upper illumination cover inner surface 16*b*, a part of the light reflects and illuminates a lower area through lower illumination cover 15. Accordingly, the illuminance increases.

Moreover, when the light emitted from luminescence elements 18 is applied to white-colored upper illumination cover inner surface 16*b*, the part of the light reflects, and thus a temperature rise of upper illumination cover inner surface 16*b* decreases.

A plurality of openings 15*a* are formed in a side of lower illumination cover 15 illustrated in FIG. 3. More specifically, the plurality of openings 15*a* are formed in the side of lower illumination cover 15 in such positions as to face to dissipation plates 21 provided on the side of upper illumination cover 16. Accordingly, heat dissipated from heat dissipation plates 21 is released to the outside of lower illumination cover 15 via the plurality of openings 15*a*.

Figure 5:
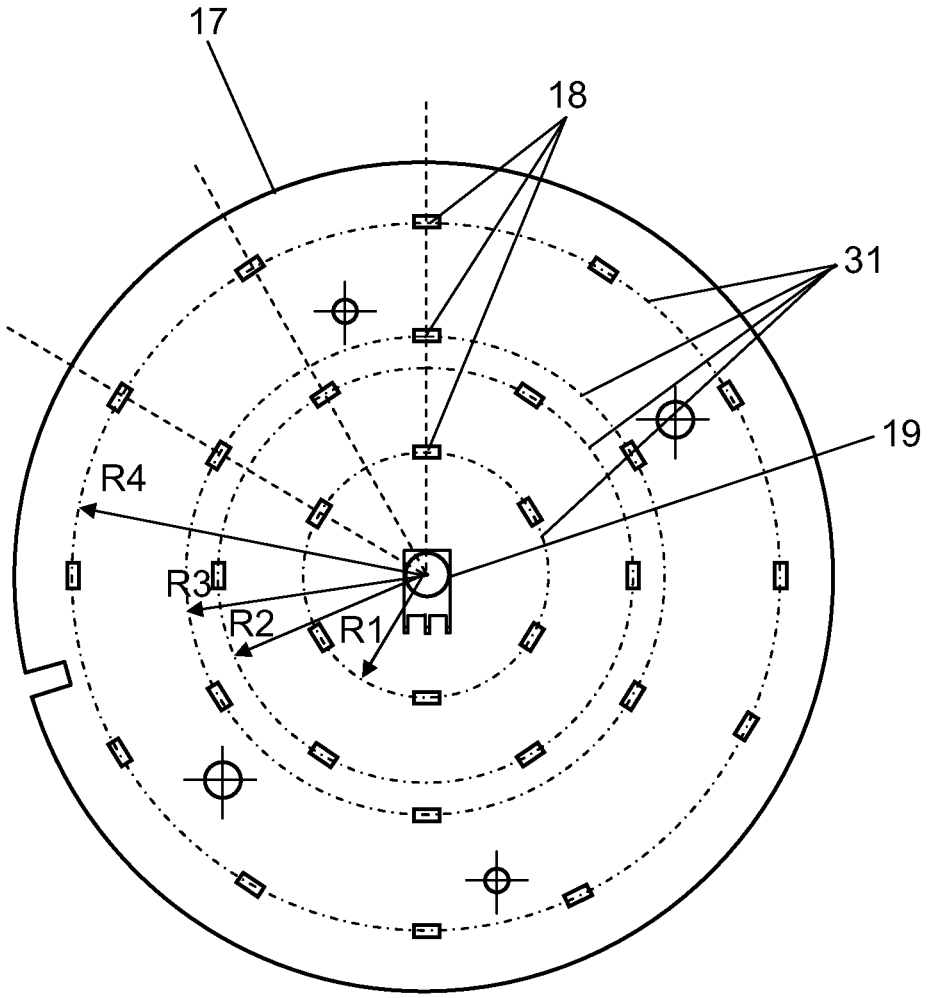
FIG. 5 is a plan view of an LED (light-emitting diode) substrate portion of the same ceiling fan.

FIG. 5 is a plan view of the LED substrate portion included in the ceiling fan according to the exemplary embodiment of the present invention. As illustrated in FIG. 5, the plurality of luminescence elements 18 are disposed individually along three or a larger number of circumferences 31. Respective centers of circumferences 31 are aligned to an identical center. More specifically, each of luminescence elements 18 is positioned on corresponding one of circumferences 31 having different radii R1, R2, - - - , Rn. The value n is 3 or larger. The radii of circumferences 31 become larger with increase in the value n. A difference in radii Rn−R(n−1) is largest among differences in radii of all adjacent pairs of the circles.

More specifically, rectangular plate-shaped LED chips constituting luminescence elements 18 are attached to four circumferences 31 having different radii and centered at receiving portion 19. In this case, the LED chips are arranged such that each longer side of the LED chips extends along corresponding one of circumferences 31.

Respective luminescence elements 18 are disposed such that the radius difference Rn−R(n−1) becomes the largest in the radius differences of respective adjacent pairs of the circles. In this arrangement, the number of luminescence elements 18 disposed on the outer circumferential side of LED substrate portion 17 decreases, while the number of luminescence elements 18 disposed on the inner circumferential side of LED substrate portion 17 increases. Thus, the total number of luminescence elements 18 decreases. Accordingly, reduction of a temperature rise in upper illumination cover 16 illustrated in FIG. 3 is achievable. Furthermore, the color of upper illumination cover inner surface 16*b* is white-colored, wherefore light emitted from luminescence elements 18 positioned on circumference 31 having radius Rn reflects. Accordingly, light is uniformly emitted from lower illumination cover 15 even when the number of luminescence elements 18 disposed on the outer circumferential side of LED substrate portion 17 decreases, and the number of luminescence elements 18 disposed on the inner circumferential side of LED substrate portion 17 increases.

Light emitted from each adjacent pair of luminescence elements 18 illustrated in FIGS. 3 and 5 overlaps with each other on lower illumination cover 15 in an area other than a central portion of lower illumination cover 15. A distance between upper illumination cover inner surface 16*b* and circumference 31 of the circle positioned on the outermost circumference and having radius Rn is shorter than the radius difference Rn−R(n−1). Accordingly, light is further uniformly emitted from lower illumination cover 15.

Figure 6:
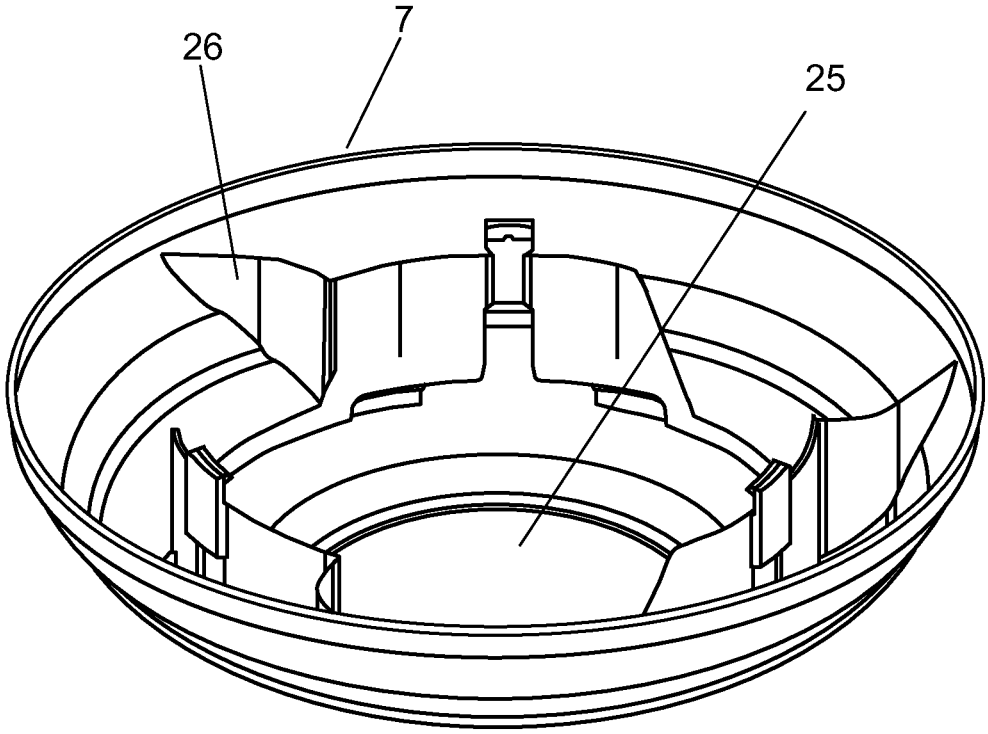
FIG. 6 is a perspective view of the case of the same ceiling fan.

FIG. 6 is a perspective view illustrating the case of the ceiling fan according to the exemplary embodiment of the present invention. As illustrated in FIG. 6, a plurality of plate-shaped divider portions 26 are disposed on an inner surface of case 7. Divider portions 26 are plate-shaped, and configured to extend in the vertical direction from the inner surface of case 7. Divider portions 26 are provided radially around case opening 25. In case 7, gap 24 illustrated in FIG. 2 communicates with openings 27 of control case 13 illustrated in FIG. 3.

According to the foregoing configuration, air in case 7 is stirred when blade portions 4 and support portion 23 illustrated in FIG. 2 are rotated. Then, air supposedly enters from a part of gap 24 along divider portions 26 illustrated in FIG. 6, and goes out from a part of gap 24. A part of the air goes into and goes out from control case 13 illustrated in FIG. 3 through openings 27 formed in the side of control case 13, so that a temperature rise within control case 13 decreases.

Divider portions 26 are bent to a direction opposite to a rotational direction of blade portions 4. Thereby, an entrance direction of air from a part of gap 24, and an extension direction of divider portions 26 from the outside to the inside of case 7 become substantially the same direction during rotation of blade portions 4 and support portion 23 illustrated in FIG. 2. Accordingly, air supposedly more easily enters from a part of gap 24 along divider portions 26. As a result, further reduction of a temperature rise within control case 13 is achievable.

INDUSTRIAL APPLICABILITY

Accordingly, provided according to the present invention is a useful ceiling fan appropriate for house use and office use, for example.

The invention claimed is:

1. A ceiling fan comprising:

a support;

a motor portion provided at a lower portion of the support;

a blade portion rotated by the motor portion;

a control section provided below the motor portion;

an illumination portion provided below the control section; and a case that covers at least a part of the motor portion, the control section, and the illumination portion, wherein the illumination portion includes a cylindrical lower illumination cover sandwiched between the control section and the case, and having a closed lower portion, a cylindrical upper illumination cover sandwiched between the lower illumination cover and the control section, and having a closed upper portion, and an LED substrate portion fixed to the upper illumination cover, and having a plurality of luminescence elements attached thereto, and a heat dissipation portion is provided on a side of the upper illumination cover, the heat dissipation portion includes a plurality of heat dissipation plates, a side of the lower illumination cover includes a plurality of openings positioned to face the heat dissipation plates to thereby release heat from the heat dissipation plates to outside of the lower illumination cover.

2. The ceiling fan according to claim 1, wherein the upper illumination cover becomes wider to a downward direction, and the heat dissipation plates that protrude from the upper illumination cover have a longer protruding length at upper portions than a protruding length at lower portions.

3. The ceiling fan according to claim 1, wherein the upper illumination cover is made of aluminum.

4. The ceiling fan according to claim 1, wherein the LED substrate portion is plate-shaped, the plurality of luminescence elements are attached to a lower surface of the LED substrate portion, and at least a part of an upper surface of the LED substrate portion is in contact with an upper inner surface of the upper illumination cover.

5. The ceiling fan according to claim 4, wherein the plurality of luminescence elements are disposed individually along circumferences of concentric circles having radii R1, R2, - - - , Rn, where a value n is 3 or larger, the radii of the circles become larger with increase in the value n, and a difference in radii Rn−R(n−1) is largest among differences in radii of all adjacent pairs of the circles, and light emitted from each adjacent pair of the plurality of luminescence elements overlaps with each other on the lower illumination cover in an area other than a central portion of the lower illumination cover.

6. The ceiling fan according to claim 1, wherein an inner surface of the upper illumination cover is white-colored.

7. The ceiling fan according to claim 1, wherein the case is bowl-shaped and opened on an upper side, includes a case opening in a lower portion, is located below the blade portion with a gap between a case upper end portion of the case and the blade portion, and includes a plurality of plate-shaped divider portions disposed radially on an inner surface around the case opening of the case.

8. The ceiling fan according to claim 7, wherein the divider portions are bent with respect to a rotational direction of the blade portion so that an entrance direction of air from a part of the gap and an extension direction of divider portion from outside to inside of the case becomes substantially same direction during rotation of blade portion and support portion.

* * * * *